United States Patent [19]

Puhak

[11] 4,165,143

[45] Aug. 21, 1979

[54] ELECTRON TUBE SOCKET SECURING MEANS

[75] Inventor: Peter G. Puhak, Seneca Falls, N.Y.

[73] Assignee: GTE Sylvania Incorporated, Stamford, Conn.

[21] Appl. No.: 930,766

[22] Filed: Aug. 3, 1978

[51] Int. Cl.[2] ..... H01J 5/60; H01R 13/54; H01R 33/82

[52] U.S. Cl. ..... 339/75 T; 313/325; 339/91 L; 339/145 T

[58] Field of Search ..... 339/75 T, 91 L, 144 T, 339/145 T; 313/318, 325

[56] References Cited

U.S. PATENT DOCUMENTS 2,113,328 4/1938 Makenny ..... 339/91 L X 4,054,346 10/1977 Schultz ..... 339/75 T

FOREIGN PATENT DOCUMENTS 950213 3/1949 France ..... 339/91 L

*Primary Examiner*—E. F. Desmond

*Attorney, Agent, or Firm*—William H. McNeill

[57] ABSTRACT

Means is provided for expeditiously securing a socket to the finned base of an electron tube. Upon seating the base in the socket, a discretely formed locking pin is positioned within a slanted bore traversing the end portion of a fin, whereby the terminal end of the pin abuts the surface of the socket thus effecting securement of the socket-to-base combination. The invention is particularly useful in electronic equipment wherein cathode ray tubes are employed.

10 Claims, 5 Drawing Figures

FIG. 1
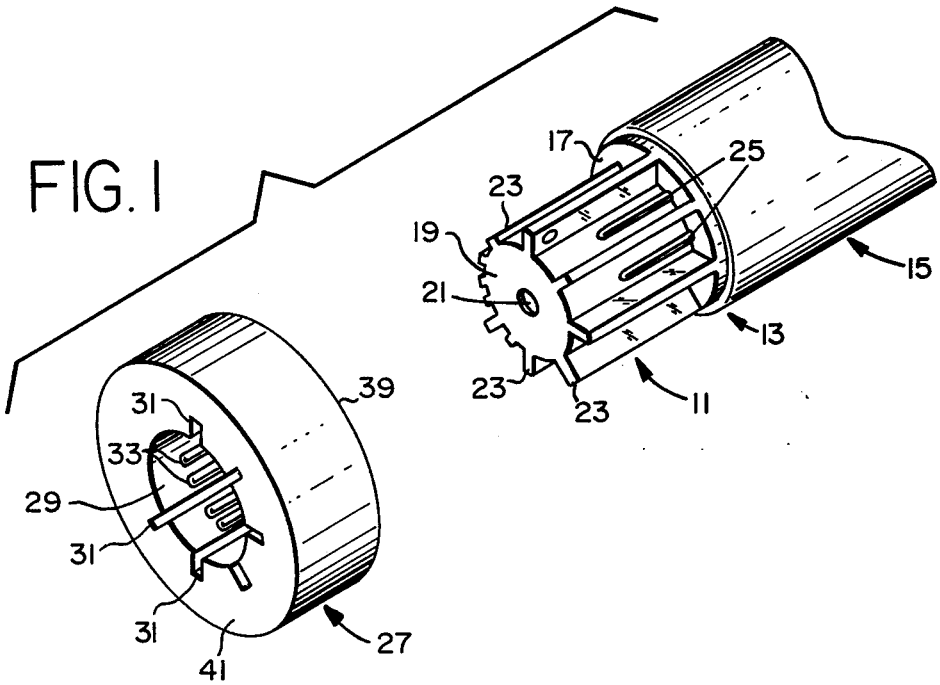
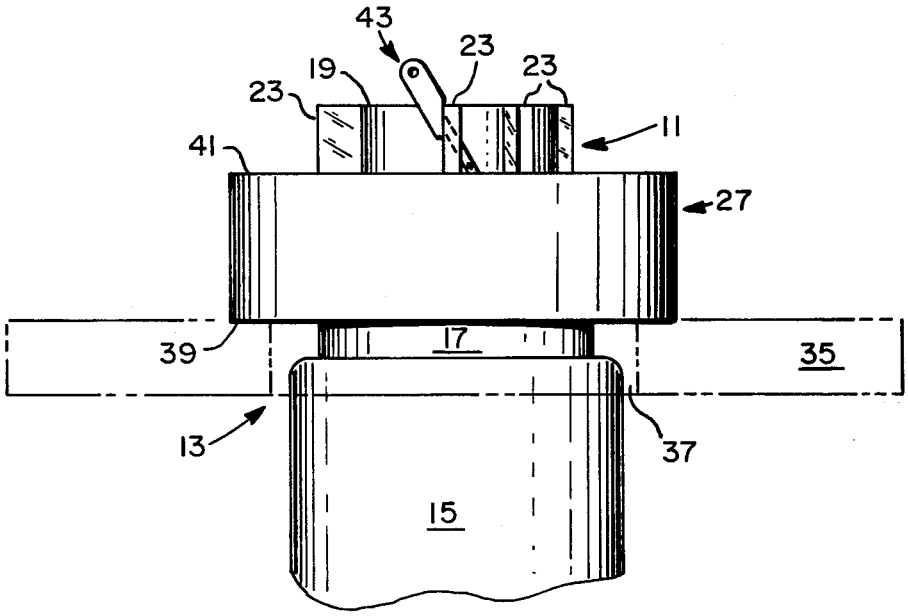
FIG. 2

ELECTRON TUBE SOCKET SECURING MEANS

TECHNICAL FIELD

This invention relates to means for securing a socket to the base of an electron tube and more particularly to pin means discretely cooperating with a bore in a fin of the base to effect releaseable securement of the socket to the base.

BACKGROUND ART

In the utilization of specialized types of electron tubes in electronic equipment, for example, the employment of cathode ray tubes in certain color image display applications, it is conventional practice to integrate adjustable portions of the tube control circuitry on a sub-chassis arrangement attached to the socket of the tube. This associated circuitry adds mass to the socket component, and the additional weight, so distributed, makes the socket more vulnerable to loosening when the television set or display device is subject to jarrings or vibrations, such as those encountered during transportation and handling. The tubes so employed often utilize a finned base structure wherein an array of substantially parallel fins is arranged to selectively isolate the individual connector leads protruding from the neck closure portion of the tube. The associated socket is a compatible structure having a base accommodating opening therethrough wherein fin receiving means and an array of slide contactors are peripherally oriented to make pressured contact with the individual connector leads of the tube. The length of the finned-base is such that, when seated on the socket, a portion of the base and integrated fin structures protrude or egress through the opening in the socket to extend from the opposite side thereof. The ancillary chassis, attached to the socket, is usually an insulative structure whereon the adjustable circuitry components are conveniently arranged.

Several means have been used in the art to assure securement of such base and socket combinations. For example, one means employs a plurality of spaced-apart arms which extend rearward from an added-on portion of a conventional convergence device externally positioned on the neck of the tube. the termini of these arms are fashioned to protrude through openings in the ancillary chassis structure and make snap attachment thereto, thereby securing the socket to the base. This pluralarm construction adds extra structure and mass to the neck portion of the tube, and is an item representing appreciable fabrication cost.

In another example of base-to-socket securement a small hole is formed in that portion of a base fin which egresses from the socket when the base is seated thereon. The hole is formed normal to the plane of the fin and is oriented close to the near surface of the socket. A piece of flexible metallic or plastic strand is threaded through the hole, and then secured to form a loop-type stop means for preventing the base from being withdrawn from the socket. Threading the strand through the hole and securing the ends is a tedious and timeconsuming procedure.

DISCLOSURE OF THE INVENTION

In one aspect of the invention expeditious means are provided for easily achieving releasable securement of a finned base of an electron discharge device to an associated socket member. The socket has an opening therethrough dimensioned to accommodate the finned portion of the base when the base is seated thereon. In being so seated, at least one of the base fins has a terminal portion egressing from the opposite surface of the socket. A bore is formed in a slanted manner through the egressing portion of the fin. A substantially longitudinal locking pin, having a length greater than that of the bore, is formed of integrated handling and shank sections. This pin is slidingly accommodated within the bore in a manner that the end surface of the shank section abuts the surface of the socket. Retentive means associated with the end of the shank section of the pin are formed to interact with the surface of the egressing portion of the fin. This interaction between the pin and the fin constrains the accidental removal of the pin from the bore thereby effecting facile and positive securement of the socket to the base. Thus, the invention provides enhanced and assured operation of the electronic equipment wherein it is utilized.

BRIEF DESCRIPTION OF THE DRAWINGS

FIG. 1 is an explosed perspective view showing the finned base of an electron discharge device and the socket member associated therewith;

FIG. 2 is an elevational view showing the base in seated combination with the socket and illustrating the base-to-socket securing means of the invention;

BEST MODE FOR CARRYING OUT THE INVENTION

Figure 3:
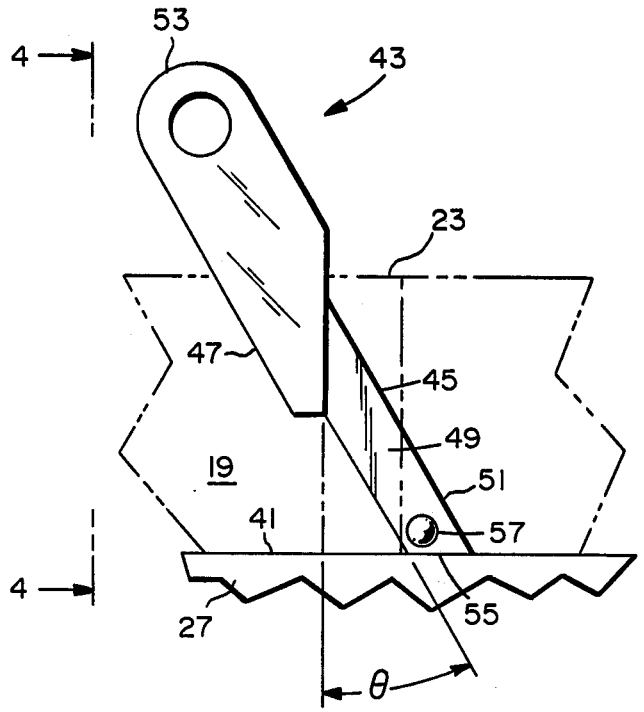
FIG. 3 is an enlarged side view of the base-to-socket securing means shown in FIG. 2.
Figure 4:
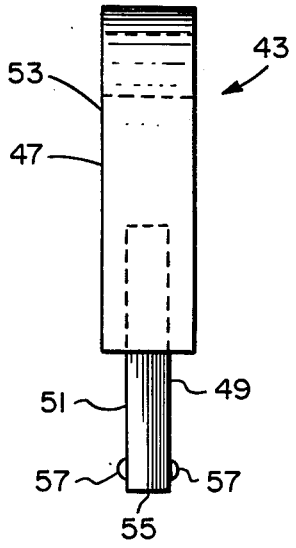
FIG. 4 is an illustration of the locking pin portion of the invention taken along the line 4—4 of FIG. 3.

For a better understanding of the present invention, together with the advantages and capabilities thereof, reference is made to the following specification and appended claims in connection with the aforedescribed drawings.

With reference to the drawings, there is shown in FIG. 1 an exploded presentation of a finned type base structure 11 mounted on the terminal closure portion of an electron discharge device, which for example, may be the sealed neck portion 13 of a cathode ray tube 15. Such exemplary usage will be delineated in this specification although it is not intended to be limiting. The base 11 comprises a substantially planar portion 17 having a central crown portion 19 fashioned as a hollow structure to receive and protect the sealed exhaust tubulation of the tube, not shown. This hollow crown may have an opening 21 through which a viscous adhesive material, such as a room temperature vulcanizing (RTV) silicone rubber composition, is introduced to encapsulate the tubulation and adhere the base to the tube. Surrounding the crown is an annular array of spacedapart longitudinal fins 23 arranged in parallel orientation to selectively isolate the individual electrical connector leads or pins 25 which protrude from the neck closure portion of the tube 15 and thence transverse receiving apertures in the planar portion 17 of the base structure.

The associated socket 27 is a compatible structure having a base-accommodating opening 29 therethrough wherein a plurality of fin receiving channels 31, and an array of slide contactors 33 are peripherally oriented to make pressured contact with the individual connector leads 25 of the tube when the base and socket are seated in combination.

The assembled base and socket combination is illustrated in FIG. 2. As previously mentioned, in certain television and like display applications, it is conventional practice to integrate portions of tube control circuitry in an insulative sub-chassis structure 35 (shown in phantom) attached to a flat surface of the socket of the tube 27. This circuit board 35 has an opening 37 therethrough to accommodate the placement of the finned base 11 in the socket 27. Since this sub-chassis component has no direct bearing on the invention, further delineation of that item is omitted.

It is to be noted that the length of the finned base 11 is such that, when seated on surface 39 of the socket 27, a terminal portion of the crown 19 and terminal segments of the fin structures 23 integrated therealong, protrude through the socket opening 29, egressing from surface 41 which is opposite surface 39.

The invention relates to means for releasably securing the socket member 27, to the finned base 11, such being exemplarily illustrated in FIGS. 2 through 5. The securing means is in the form of a locking pin 43 positioned within a slanted bore 45 formed through an egressing portion of one of the base fins 23.

The angular orientation of the bore 45 within the fin 23 is important both from the standpoint of bore formation and most effective anchoring or securement characteristics manifested by the related locking pin arrangement. It has been found that the acute angle of slant 10 between the plane of the bore 45 and the plane of the fin 23 is desirably within the range of 20° to 40°, and more preferably within the range of 28° to 32°.

The locking pin 43 is a substantially longitudinal member having a length greater than that of the bore 45. It is formed, for example, of a plastic material such as high density polyethylene which exhibits characteristics of both rigidity and resilience. constructionally, it is comprised of integrated handle 47 and shank 49. The shank 49 has a proximal terminal portion 51, and the handle 47 an opposed distal terminal portion 53. The bore 45 in the fin 23 and the shank 49 of the pin 43 are of compatible cross-sectional formations. In this instance rectangular cross-sections are delineated. As shown, the shank 49 of the locking pin is slidingly accommodated within the slanted bore 45 in a manner that the end surface 55 of the proximal portion 51 substantially abuts the surface 41 of the socket 27.

Pin retentive means 57 are formed on the proximal portion 51 of the shank section 49 of the pin in a manner to interact with the egressing portion of the base fin 23 to constrain the accidental removal of the pin from the bore thereby securing the base to the socket. An example of such retentive means is the formation of at least one blister-shaped or raised protrusion 58 outstanding slightly from the proximal portion 51 of the shank section 49. Slight pressure is necessary to insert the shank into the bore, during which the raised protrusion 58 is somewhat compressed; but upon emergence from the bore, the protrusion assumes its original shaping thereby providing a releasable locking interaction with the surface of the fin contiguous to the bore. Thus, the socket and base are facilely secured in combination, with the provision that the locking pin can be removed upon the application of suitable force.

Figure 5:
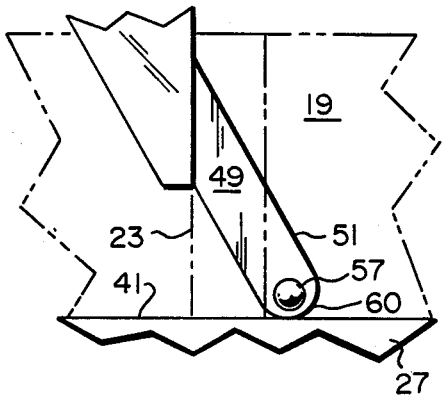
FIG. 5 is a view showing another terminal embodiment of the locking pin.

As shown in FIG. 3, in a first and preferred embodiment, the end surface 55 of the pin shank proximal portion 51 is substantially planar and in substantial abutment with the parallel surface 41 of the socket 27. Another embodiment of the shaping of the end surface of the shank portion is shown in FIG. 5 wherein the surface 60 is substantially rounded.

The handle 47 of the locking pin may be of larger cross section than that of the shank to facilitate handling of the pin. In this instance, it is shown as substantially seating against the fin 23. The distal terminal portion 53 has means formed therein or thereon to provide facile positioning and removal of the pin from the bore. By way of example, at least one hole or aperture is formed in the handle section. This enables the use of a hook-type tool for convenient manual manipulation of the pin relative to the bore in the fin.

INDUSTRIAL APPLICABILITY

Thus, means are provided for facilely achieving releasable but positive securement of a finned base to its associated socket. The means involves a minimum of structural mass and the easy manipulation of a single reusable locking pin component for assuring attachment of the socket to the tube base in the manufacture of electronic equipment. Use of this structure reduces and obviates the disadvantages of the prior art.

I claim:

1. Means for releasably securing a socket member to the finned base of an electron tube, said socket having opposed surfaces and an opening formed therethrough dimensioned and configured to accommodate said base in an encompassing manner, said base being seated relative to one of said surfaces and having the terminal portion of at least one base fin egressing from an opposite surface of said socket, the improvement comprising: a bore formed in a slanted manner through the egressing portion of said base fin; and a substantially longitudinal locking pin having a length greater than that of said bore and formed of an integrated handle and shank, said shank having a proximal terminal portion and said handle an opposed distal terminal portion, said pin being slidingly accommodated within said bore in a manner that the end surface of said proximal portion substantially abuts a surface of said socket, said pin having retention means associated with the proximal portion of said shank and formed to interact with the egressing portion of said fin to constrain the removal of said pin from said bore thereby releasably securing said base to said socket.

2. The socket securing means of claim 1 wherein the end surface of said shank proximal portion is substantially parallel with a surface of the socket.

3. The socket securing means of claim 1 wherein the end surface of said shank proximal portion is substantially rounded.

4. The socket securing means of claim 1 wherein the handle of said locking pin has means formed therein for facilely positioning and removing said locking pin from said bore.

5. The socket securing means of claim 1 wherein said electron tube is a cathode ray tube wherein the finned base selectively isolates the individual connector leads protruding from the neck closure portion of said tube, and wherein said socket evidences an array of slide contactors positioned to make pressured contact with said respective leads, and wherein said slanted bore is oriented in a plane substantially normal to that of said respective fin.

6. The socket securing means of claim 5, wherein said bore in said fin is substantially rectangular in cross-section, and wherein said pin shaft section is of similar configuration.

7. The socket securing means of claim 5 wherein said bore is slanted in a plane angularly oriented within a range of 20°–40° from the plane of said fin.

8. The socket securing means of claim 7 wherein the angular orientation of said bore is within the range of 28°–32°.

9. The socket securing means of claim 1 wherein said pin is formed of a plastic material exhibiting characteristics of both rigidity and resilience.

10. The socket securing means of claim 9 wherein said pin retention means includes at least one blister-shaped raised formation outstanding slightly from the proximal portion of said shank.

* * * * *